US006234049B1

(12) United States Patent
Ju et al.

(10) Patent No.: US 6,234,049 B1
(45) Date of Patent: May 22, 2001

(54) TOOL HAVING A SWING HEAD ROTATABLE WITHIN A SMALL SPACE

(76) Inventors: De-Cheng Ju, No. 369, Shihu Road; Bing-Kwe Lim, 7Fl., No. 1059, Ren Yu Rd., both of Dali City, Taichung (TW)

( * ) Notice: Subject to any disclaimer, the term of this patent is extended or adjusted under 35 U.S.C. 154(b) by 0 days.

(21) Appl. No.: 09/474,244

(22) Filed: Dec. 29, 1999

(51) Int. Cl.[7] ..... B25B 13/46
(52) U.S. Cl. ..... 81/57.39; 81/177.7
(58) Field of Search ..... 81/57.39, 177.2, 81/177.7, 177.8

(56) References Cited

U.S. PATENT DOCUMENTS 4,334,445 * 6/1982 Timewell ..... 81/177.7
4,991,470 * 2/1991 Singleton ..... 81/177.7
5,517,844 * 5/1996 Sanders ..... 81/60
5,584,220 * 12/1996 Darrah et al. ..... 81/57.29
5,896,789 * 4/1999 Giardino ..... 81/57.39

* cited by examiner

*Primary Examiner*—James G. Smith
*Assistant Examiner*—David B. Thomas
(74) *Attorney, Agent, or Firm*—Rosenberg, Klein & Lee

(57) ABSTRACT

A tool includes a base having a slot defined in an end thereof and a head pivotally engaged with the slot. An output shaft extends from the head and a recess is defined in an end of the head. A tube extends from the base and a shank extends through the tube. An eccentric rod extends longitudinally from the shank and is located in the slot and is retained within the recess. When rotating shank, the head is rotated about the output shaft by the movement of the eccentric rod.

2 Claims, 3 Drawing Sheets

TOOL HAVING A SWING HEAD ROTATABLE WITHIN A SMALL SPACE

FIELD OF THE INVENTION

The present invention relates to a ratchet tool, and more particularly, to an improved ratchet tool that has a swing head which is rotated within a small angle by an eccentric member connected to a rod in the shank.

BACKGROUND OF THE INVENTION

A conventional ratchet tool generally includes a head within which a ratchet mechanism is received, a shank extending from the head. The head has an output shaft to be engaged with a socket and when rotating the shark, the socket can be reciprocatingly rotated without removing the socket from the object. The ratchet mechanism generally includes a toothed member and a pawl member which is engaged with the toothed member to decide the effective direction of the toothed member to which the Output shaft is connected. In the effective direction, the toothed member and the output shaft both are rotated so as to tighten or loosen an object. In the opposite direction, only the toothed member is rotated while the output shaft remained still. When the toothed member is rotated with the output shaft, the pawl member is firmly engaged with the toothed member. in other words, the pawl member will not engaged with the toothed member when the gap between two adjacent teeth of the toothed member is large. The head of the ratchet tool is rotated while the output shaft is not rotated when the pawl member is located in the gap and does not firmly engaged with any tooth of the toothed member. Obviously, the conventional ratchet tool cannot be used in a small space because the small space allows the head to be rotated only a small angle.

The present invention intends to provide a tool having a head which is actuated to rotate about the output shaft by an eccentric rod connected to a rotatable shank of the tool so that when rotating the shank, the head is rotated a small angle so that the tool is especially suitable to be used in a small space.

SUMMARY OF THE INVENTION

In accordance with one aspect of the present invention, there is provided a tool having a head with an output shaft extending therefrom and a recess is defined in an end of the head. The head is pivotally received in a slot of a base and a tube extends from the base. A shank has an eccentric rod extending longitudinally from a first end thereof and the shank 40 extends through the tube so that the eccentric rod is located in the slot and retained in the recess of the head.

The object of the present invention is to provide a tool that has a rotatable shank and a head which is rotated a small angle when rotating the shank.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
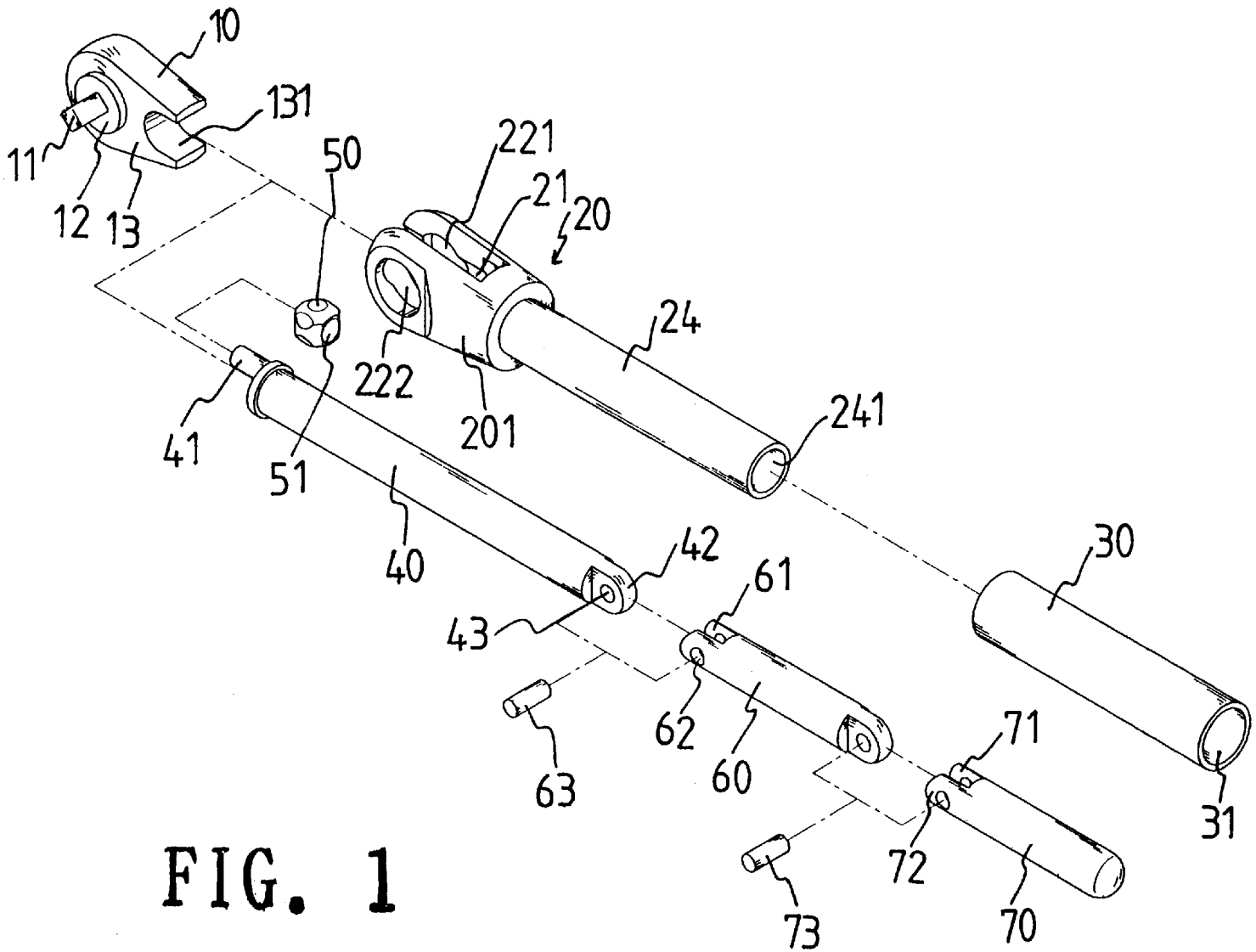
FIG. 1 is an exploded view to show a tool of the present invention.
Figure 2:
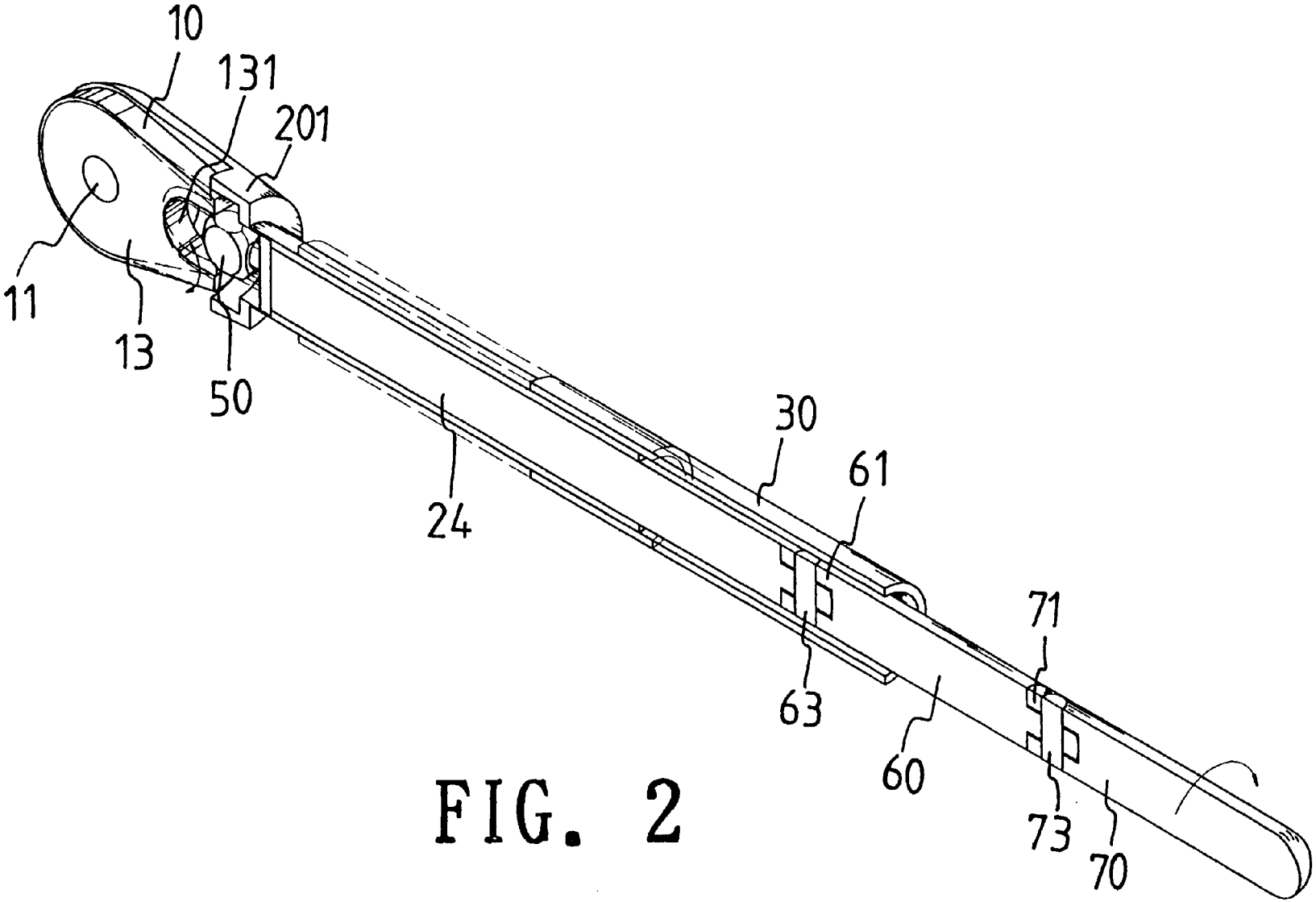
FIG. 2 is an illustrative view to show all the parts connected with each other to become the tool of the present invention.
Figure 3:
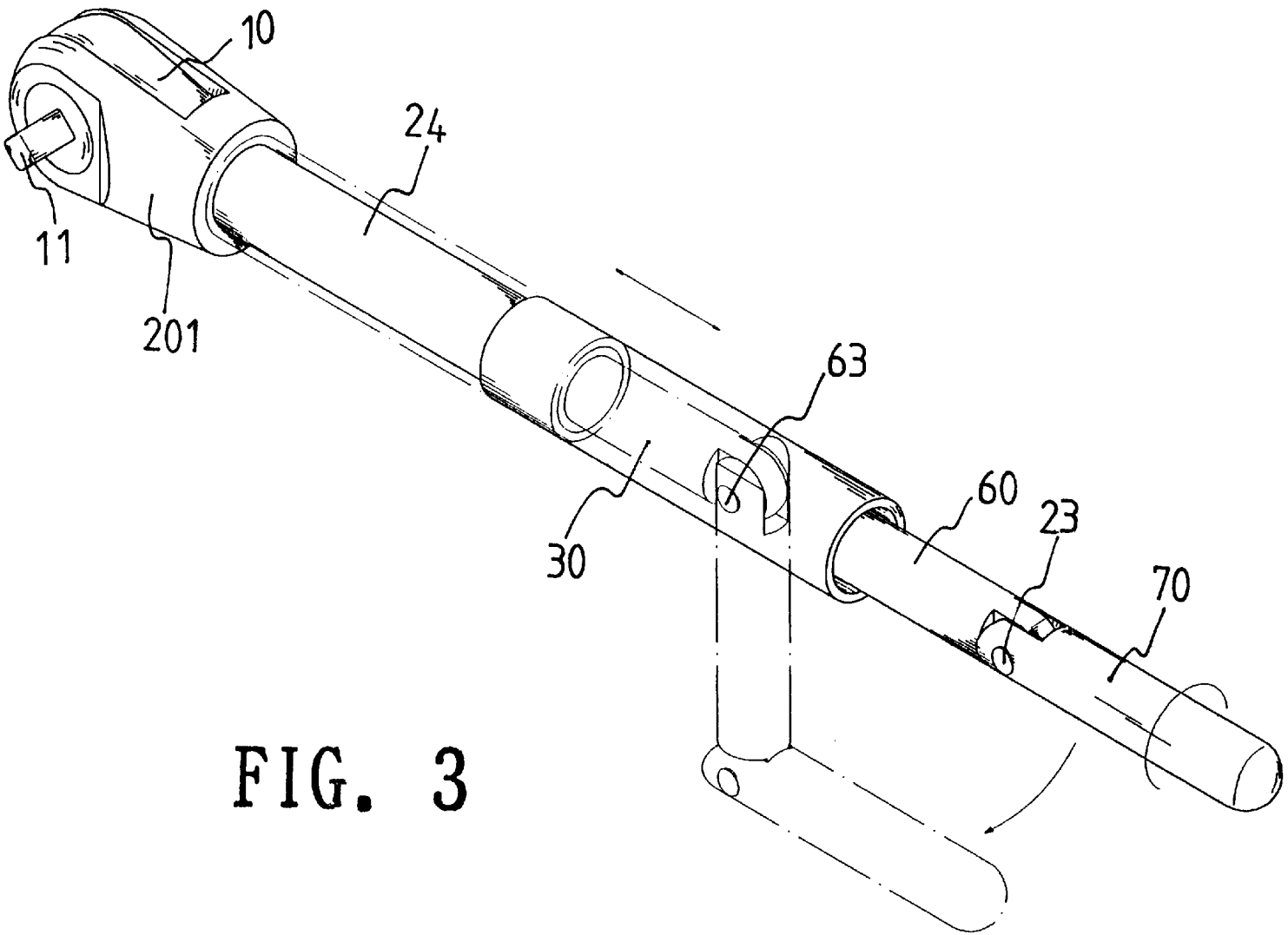
FIG. 3 is an illustrative view to show that the extension rod is pivoted about the shank of the tool of the present invention.

Referring to FIGS. 1 to 3, the tool in accordance with the present invention comprises a head 10 having an output shaft 11 extending therefrom and a recess 131 defined in an end 13 of the head 10. A direction selection disk 12 is located on a side of the head 10 and the output shaft 11 extends from the disk 12 so that when rotating the disk 12, the output shaft 11 can output a torque. A base 20 has an end member 201 and a tube 24 extends from the end member 201. The end member 201 has two side members extending therefrom so as to define a slot 21 between the two side members. The two side members respectively have a hole 221/222 defined therethrough so that when sad head 10 is received in the slot 21, the output shaft 11 extends through the hole 222 and a cover (not shown) is engaged with the other hole 221.

A shank 40 has an eccentric rod 41 extending longitudinally from a first end of the shank 40 and the shank 40 extends through the tube 24 via the opening 241. The eccentric rod 41 is located in the slot 21 and a block 50 is connected to the eccentric rod 41 so that the block 50 is engaged with the recess 131 of the head 10. A lug 42 extends from a second end of the shank 40. An extension rod 60 has two lugs 61 extending from a first end thereof and a connection lug extends from a second end of the extension rod 60. The lug 42 is pivotally connected between the two lugs 61 of the extension rod 60 by extending a pin 63 through a hole 43 in the lug 42 and two respective holes 62 in the two lugs 61. An operation member 70 has two lugs 71 extending from an end thereof and a pin 73 extends through the connection lug on the second end of the extension rod 60 and the holes 72 in each lug 71 of the operation member 70. Therefore, the extension rod 60 and the operation member 70 can be pivoted relative to an axis of the shank 40 as shown in FIG. 3.

A sleeve 30 is slidably mounted to the tube 24, the shank 40 and the extension rod 60 so that when the sleeve 30 is moved to a position where the pivotal joints between the are located within the sleeve 30, the extension rod 60 and the operation member 70 cannot be pivoted. When rotating the operation member 70 or the extension rod 60, the shank 40 is rotated and the eccentric rod 41 together with the block 50 are moved in the recess 131 so that the head 10 is rotated a small angle reciprocatingly about the output shaft 11. Accordingly, in a small space, the tool of the present invention can be precisely used to output a torque. Furthermore, in the small space, the shank 40 of the tool does not need to swing reciprocatingly so that the tool is convenient to be used in a small space.

While we have shown and described various embodiments in accordance with the present invention, it should be clear to those skilled in the art that further embodiments may be made without departing from the scope and spirit of the present invention.

What is claimed is:

1. A tool comprising:

a head having an output shaft extending therefrom and a recess defined in an end of said head;

a base having an end member and a tube extending from said end member, said end member having two side members extending therefrom so as to define a slot between said two side members, said head received in said slot and said output shaft extending through one of said two side members, and a shank having an eccentric rod extending longitudinally from a first end of said shank and said shank extending through said tube, said eccentric rod located in said slot and retained in said recess of said head, an extension rod pivotally connected to a second end of said shank and a sleeve slidably mounted to said tube, said shank and said extension rod.

2. The tool as claimed in claim 1 further comprising a block connected to said eccentric rod.

* * * * *